US006873321B2

(12) United States Patent
Tsutsui

(10) Patent No.: US 6,873,321 B2
(45) Date of Patent: Mar. 29, 2005

(54) DISPLAY DEVICE WITH TWO-LEVEL IMAGE REPRESENTATION

(75) Inventor: Yusuke Tsutsui, Hashima (JP)

(73) Assignee: Sanyo Electric Co., Ltd., Osaka (JP)

( * ) Notice: Subject to any disclaimer, the term of this patent is extended or adjusted under 35 U.S.C. 154(b) by 272 days.

(21) Appl. No.: 10/120,149

(22) Filed: Apr. 11, 2002

(65) Prior Publication Data

US 2002/0163591 A1 Nov. 7, 2002

(30) Foreign Application Priority Data

Apr. 11, 2001 (JP) ..... 2001-112723

(51) Int. Cl.[7] ..... G09G 5/00
(52) U.S. Cl. ..... 345/204; 345/87
(58) Field of Search ..... 345/87, 88, 89, 345/90, 92, 98, 100, 204, 949, 901, 473

(56) References Cited

U.S. PATENT DOCUMENTS

| | | | | |
|---|---|---|---|---|
| 5,712,652 A | | 1/1998 | Sato et al. | |
| 5,790,090 A | | 8/1998 | Libsch et al. | |
| 5,945,972 A | | 8/1999 | Okumura et al. | |
| 5,952,991 A | | 9/1999 | Akiyama | |
| 5,977,940 A | | 11/1999 | Akiyama et al. | |
| 6,023,308 A | | 2/2000 | Takemura | |
| 6,072,454 A | | 6/2000 | Nakai et al. | |
| 6,351,278 B1 | * | 2/2002 | Sawada et al. | 347/237 |
| 2002/0113762 A1 | * | 8/2002 | Ha | 345/87 |
| 2002/0126106 A1 | * | 9/2002 | Naito | 345/204 |

FOREIGN PATENT DOCUMENTS

| | | |
|---|---|---|
| EP | 0 797 182 | 9/1997 |
| EP | 1 020 840 | 7/2000 |
| JP | 58-23091 | 2/1983 |
| JP | 08-194205 | 7/1996 |
| JP | 09-236823 | 9/1997 |
| JP | 2001-242819 | 9/2001 |

* cited by examiner

*Primary Examiner*—Chanh Nguyen
(74) *Attorney, Agent, or Firm*—Morrison & Foerster LLP

(57) ABSTRACT

In a display device, under a analog display mode, an analog image signal amplified by an analog amplifier is outputted to a liquid crystal display panel. Under an digital display mode, after being processed by a signal processing circuit, the digital image signal is outputted to the liquid crystal display panel through a DA converter and an amplifier. For writing a "white" image signal, the signal processing circuit converts the input digital signal so that all bits of the signal are a "1." Also, for writing a "black" image signal, the signal processing circuit converts the input digital signal so that all bits of the signal are a "0."

6 Claims, 6 Drawing Sheets

DISPLAY DEVICE WITH TWO-LEVEL IMAGE REPRESENTATION

BACKGROUND OF THE INVENTION

1. Field of the Invention

This invention relates to a display device, specifically to a display device which is incorporated into a portable communication and computing device.

2. Description of the Related Art

There has been a great demand in the market for portable communication and computing devices such as a portable TV and a cellular phone. All these devices need a small, light-weight and low-power consumption display device, and efforts have been made accordingly.

FIG. 6 shows a circuit diagram corresponding to a single pixel element of a conventional liquid crystal display device. A gate signal line 51 and a drain signal line 61 are placed on an insulating substrate (not shown) perpendicular to each other. A thin-film transistor (TFT) 72 connected to two signal lines 51, 61, is formed near the intersection of the two signal lines 51, 61. A source 11*s* of the TFT 65 is connected to a display electrode 80 of a liquid crystal 21.

A storage capacitor element 85 holds the voltage of the display electrode 80 during one field period. One terminal 86 of the storage capacitor 85 is connected to the source 11*s* of the TFT 72 and the other terminal 87 is provided with a voltage common among all the pixel elements.

When a scanning signal is applied to the gate signal line 51, the TFT 72 turns to an on-state. Accordingly, an analog image signal from the drain signal line 61 is applied to the display electrode 80, and the storage capacitor 85 holds the voltage. The voltage of the image signal is applied to the liquid crystal 21 through the display electrode 80, and the liquid crystal 21 aligns in response to the applied voltage for providing a liquid crystal display image.

Therefore, this configuration is capable of showing both moving images and still images. There is a need for the display to show both a moving image and a still image within a single display. One such example is to show a still image of a battery within an area of a moving image of a cellular phone display to show the remaining amount of the battery power.

However, the configuration shown in FIG. 6 requires a continuous rewriting of each pixel element with the same image signal at each scanning in order to provide a still image. This is basically to show a still-like image in a moving image mode, and the scanning signal needs to activate the TFT 72 at each scanning.

Accordingly, it is necessary to operate a driver circuit which generates a driver signal for the scanning signals and the image signals, and an external LSI which generates various signals for controlling the timing of the driver circuit, resulting in significant electric power consumption. This is a considerable drawback when such a configuration is used in a cellular phone device which has only a limited power source. That is, the time a user can use the telephone under one battery charge is considerably decreased.

Japanese Laid-Open Patent Publication No. Hei 8-194205 discloses another configuration for a display device suitable for portable applications. This display device has a static memory for each of the pixel elements, as shown in FIG. 7. A static memory, in which two inverters INV1 and INV2 are positively fed back to each other, holds the image signal. This results in reduced power consumption.

In this configuration, a switching element 24 controls the resistance between a reference line and a display electrode 80 in response to the divalent digital image signal held by the static memory in order to adjust the biasing of the liquid crystal 21. The common electrode, on the other hand, receives an AC signal Vcom. Ideally, this configuration does not need to refresh the memory when the image stays still for a period of time.

As described above, the conventional liquid crystal display device is suitable for displaying a full color moving picture in response to the analog image signal. On the other hand, the liquid crystal display device with a static memory for retaining the digital image signal is suitable for displaying a low-depth still picture with low-power consumption.

However, two liquid crystal display devices described above have different sources for image signals, thus, it is impossible to have both images within single display device.

Therefore, this invention is directed to a display device, which can alternate between two kinds of display modes, an analog display mode and a digital display mode.

SUMMARY OF THE INVENTION

The invention provides a display device including a signal processing circuit for processing a digital image signal and a digital-analog converter for converting the processed digital image signal into an analog image signal. An analog image signal amplifier is provided for amplifying the analog image signal outputted from the digital-analog converter. A static memory circuit is provided for retaining an amplified image signal amplified by the analog signal amplifier. A display circuit is also provided for displaying an image based on the image signal retained in the static memory circuit. In this configuration, the signal processing circuit processes the digital image signal so that the processed digital image signal is converted to one of only two values by the digital-analog converter.

The invention also provides a display device including a signal processing circuit for processing a digital image signal and a digital-analog converter for converting the processed digital image signal into an analog image signal. An analog signal amplifier is provided for amplifying the analog image signal outputted from the digital-analog converter. The device has a first display circuit receiving the analog image signal amplified by the analog signal amplifier. The first display circuit operates in an analog display mode based on the analog image signal. The device also has a second display circuit having a static memory circuit for retaining the image signal fed through the digital-analog converter and the analog signal amplifier. The second display circuit operates in a digital display mode based on the image signal retained in the static memory circuit. In this configuration, the first display circuit or the second display circuit is selected corresponding to the analog display mode or the digital display mode, respectively, and, when the second display circuit is selected, the signal processing circuit processes the digital image signal so that the processed digital image signal is converted to one of only two values by the digital-analog converter, the two values being a high level and a low level.

Accordingly, it is possible to imitatively utilize the analog signal amplifier as a digital driver. That is, the analog signal amplifier can amplify the voltage amplitude of the digital image signal, allowing a simpler design of the display circuit.

DETAILED DESCRIPTION OF THE INVENTION

This invention is directed to a display device which can alternate between two kinds of display modes, an analog display mode and a digital display mode, as described in commonly owned copending U.S. patent application Ser. No. 09/953,233, entitled "DISPLAY DEVICE AND ITS CONTROL METHOD." The disclosure of U.S. patent application Ser. No. 09/953,233 is, in its entirety, incorporated herein by reference.

Figure 8:
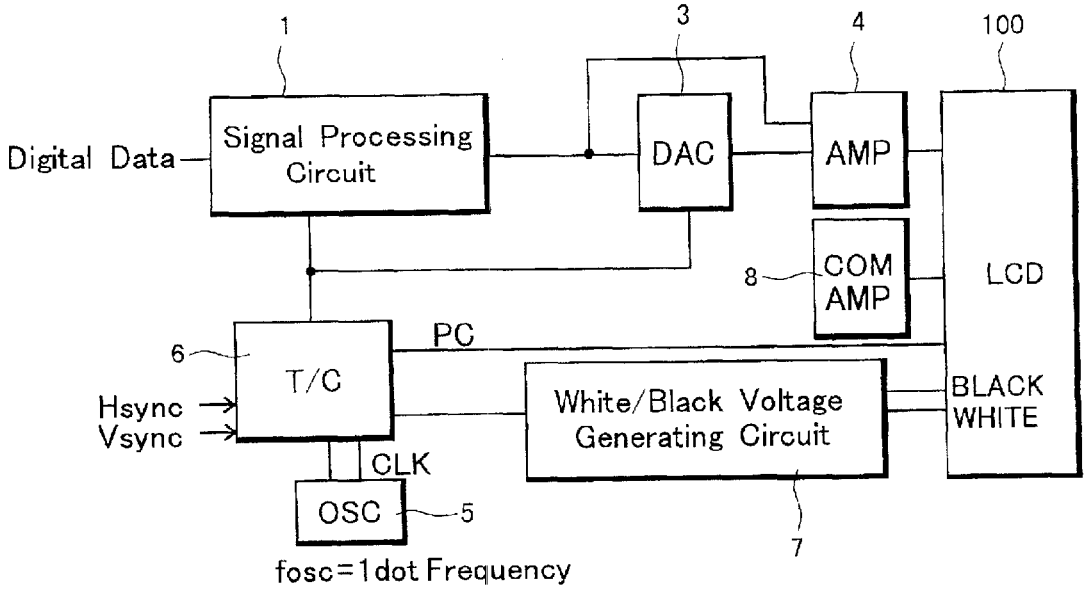
FIG. 8 is a circuit block diagram of a liquid crystal display device which provides a basis of this invention.

FIG. 8 shows a display device, which forms a basis of this invention. After being processed by the signal processing circuit 1, the digital image signal is converted to the analog image signal by the DA converter 3, and then inputted to the amplifier 4 in an analog display mode. Also, the digital image signal, which is written into a static memory, is inputted directly to the amplifier 4, without passing through the DA converter 3, in a digital display mode.

Figure 9:
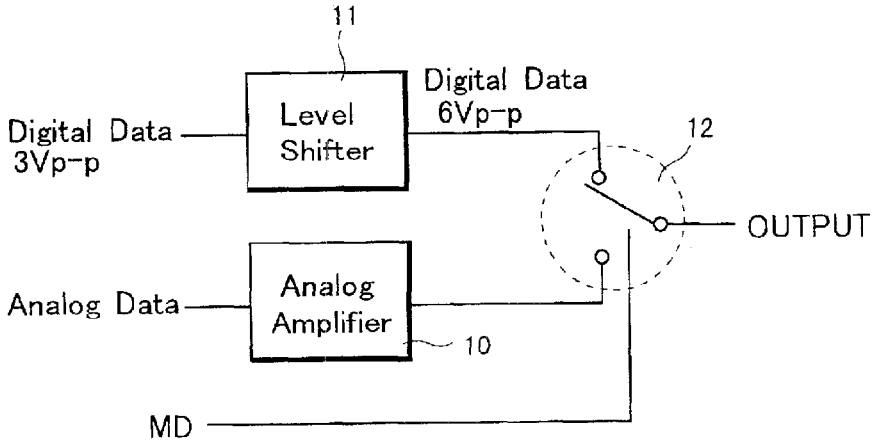
FIG. 9 is a block diagram showing a configuration of the amplifier of the liquid crystal display device of FIG. 8.

FIG. 9 shows a configuration of the amplifier of the device of FIG. 8. The analog amplifier 10 amplifies the input analog image signal. Also, the level shifter 11 raises the amplitude of the input digital image signal.

Then, a switching element 12 is triggered by a display mode switching signal MD. Therefore, under the ordinary display mode (analog display mode), the analog image signal amplified by the analog amplifier 10 is outputted to the liquid crystal display panel 100, and under the digital display mode, the digital image signal amplified by the level shifter 11 is outputted to the liquid crystal display panel 100.

Figure 1:
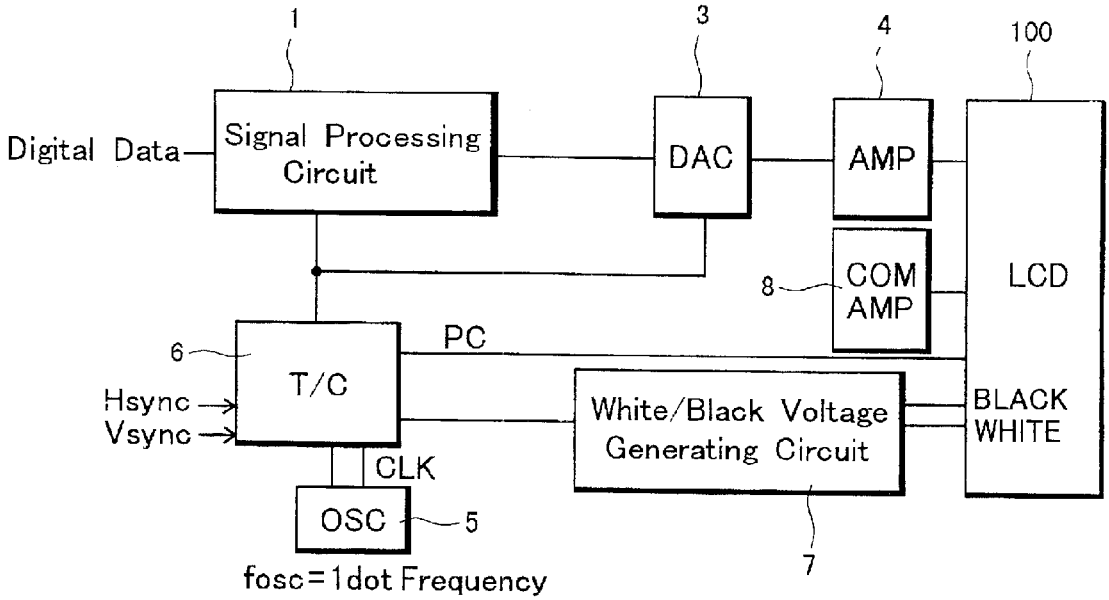
FIG. 1 is a circuit block diagram of a liquid crystal display device of an embodiment of this invention.

FIG. 1 shows a circuit diagram of a display device of an embodiment of this invention.

The signal processing circuit 1 performs various signal processing tasks such as contrast adjustment and brightness adjustment for the digital image signal inputted from outside. The processed digital image signal is converted into the analog image signal by the DA converter 3, and then inputted to the amplifier 4.

Figure 2:
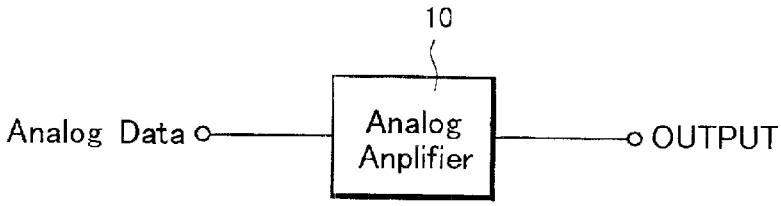
FIG. 2 is a block diagram of an amplifier of the embodiment of FIG. 1.

As seen in FIG. 2, the analog amplifier 10 of the amplifier 4 amplifies the analog image signal. Under the ordinary display mode (analog display mode), the analog image signal amplified by the analog amplifier 10 is outputted to the liquid crystal display panel 100.

On the other hand, under the digital display mode (under the mode where the image signal is written into a static memory, as mentioned later), after the signal processing circuit 1 performs the following signal processing to the digital image signal, the processed signal is outputted to the liquid crystal display device through the DA converter 3 and the amplifier 4. That is, when a corresponding pixel element is to be "white," the signal processing circuit 1 makes all bits of the data "High" ("1") and outputs the high voltage "H" through the DA converter 3. Also, when a corresponding pixel element is to be "black," the signal processing circuit 1 makes all bits of the digital data "Low" ("0") and outputs the low voltage "L" through the DA converter 3.

Figure 3:
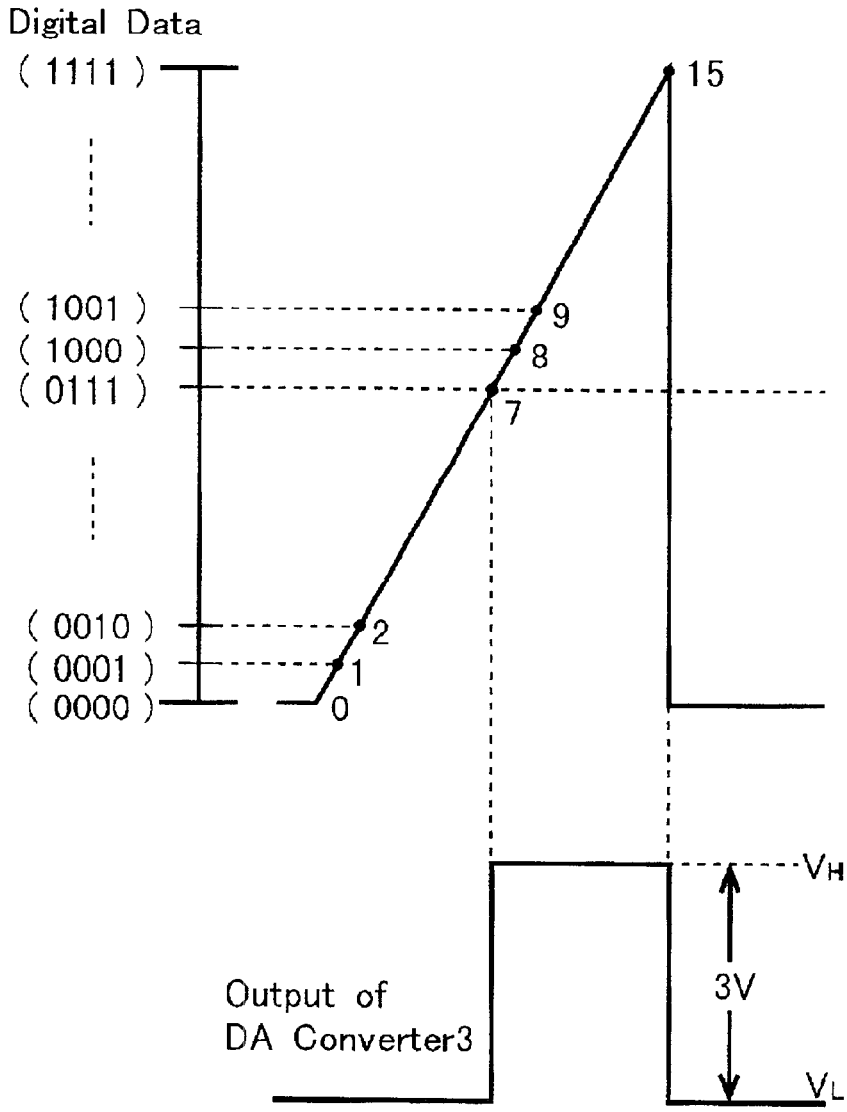
FIG. 3 is a schematic diagram showing a digital-analog conversion under a digital display mode of the embodiment of FIG. 1.

The signal processing described above is further explained by referring to the output wave shape of the DA converter 3 shown in FIG. 3. When the digital image signal from the signal processing circuit 1 has a 4-bit configuration, the output of the DA converter 3 is converted into the analog image signal corresponding to 16-level depth.

Under the digital display mode, all bits of the digital image signals with "0" at the top bit (0001)- - -(0111), is converted into "0's". Also, all bits of the digital image signals with "1" at the top bit (1000), (1001), - - -(1110) is converted into "1s". Therefore, the digital image signal becomes (1111) when a corresponding pixel element is to be "white," and is converted into (0000) when a corresponding pixel element is to be "black." Thus, when the digital-analog conversion is performed on the digital image signal processed in the above manner, a divalent output with the high voltage (VH) and the low voltage (VL) is obtained. Also, by amplifying the signal by the analog amplifier 10 after the digital-analog conversion, as shown in FIG. 3, a divalent digital signal with a voltage amplitude of about 3V is obtained.

Therefore, by setting the threshold voltage of the static memory of the liquid crystal display panel between the high voltage (VH) and the low voltage (VL), the digital image signal can be written through the analog amplifier 10.

The timing control circuit 6 outputs the control signals for controlling the panel drive signal PC, signal processing circuit 1, and the DA converter 3 based on the system clock CLK, horizontal synchronization signal Hsync and the vertical synchronization signal Vsync from the oscillator 5.

The white/black generating circuit 7 outputs the white signal (signal B) and the black signal (signal A) to the liquid crystal display panel 100 in response to the signal from the timing control circuit 6. Reference numeral 8 is the amplifier for amplifying the common electrode drive signal of the liquid crystal.

Figure 4:
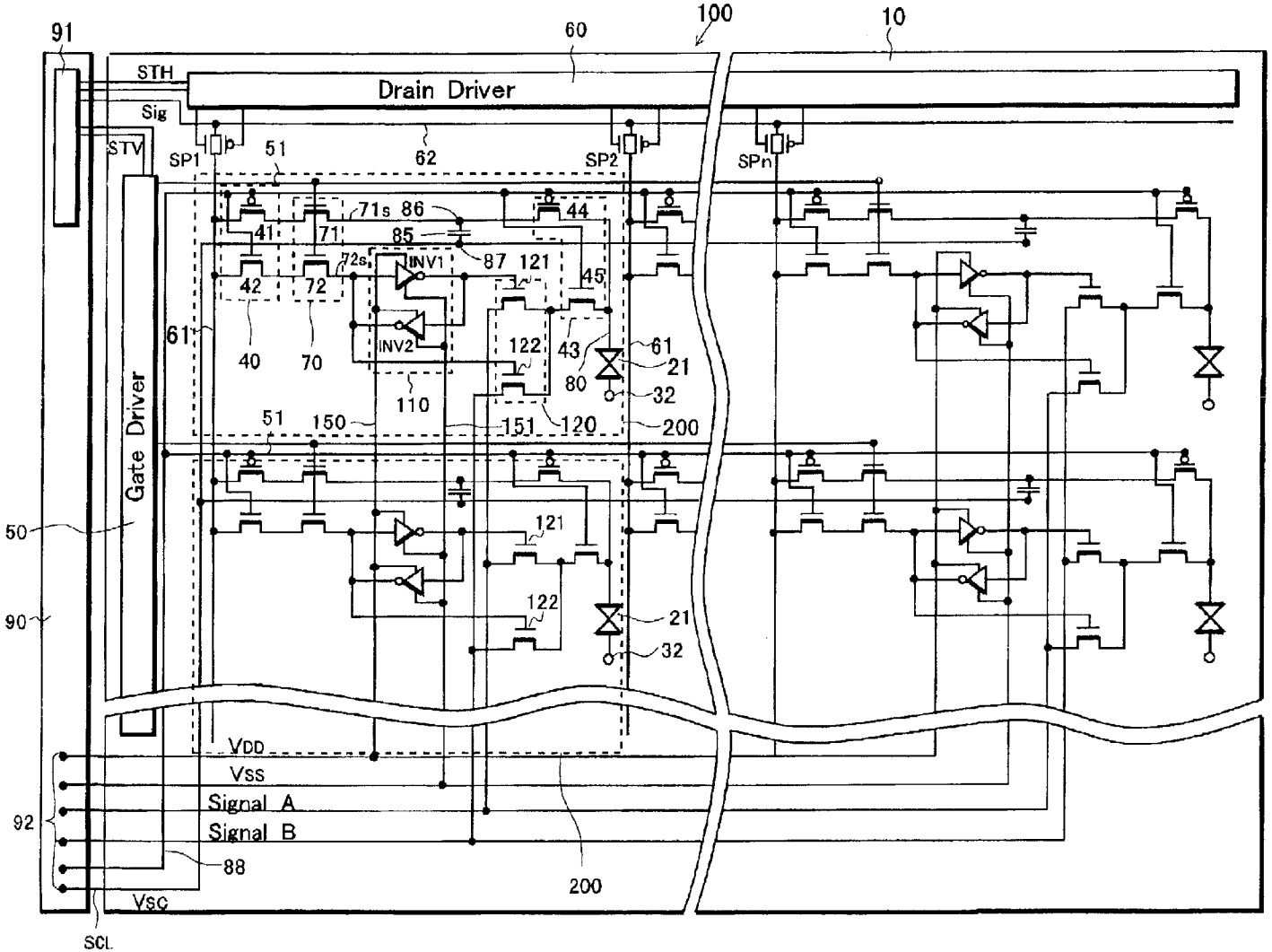
FIG. 4 is a circuit diagram of the liquid crystal display device of the embodiment.

Next, the configuration of the liquid crystal display device, especially the liquid crystal display panel 100, will be explained by referring to the circuit diagram shown in FIG. 4.

On an insulating substrate, a plurality of gate signal lines 51 connected to a gate driver 50 supplying the scanning signal are disposed in one direction. A plurality of drain signal lines 61 are disposed in the direction perpendicular to the gate signal line 51.

In response to the timing of the sampling pulse outputted from a drain driver 60, the respective sampling transistors SP1, SP2, - - - SPn sequentially turn on, supplying a data signal (analog image signal or digital image signal) of a data signal line 62 to the drain signal line 61.

On a liquid crystal display panel 100, a plurality of display pixel elements are disposed in a matrix configuration, which are selected by a scanning signal fed from the gate signal line 51 and which are provided with the data signal fed from the drain signal line 61.

The detailed configuration of a display element 200 will be explained hereinafter. A circuit selection circuit 40 comprising a P channel TFT 41 and an N channel TFT 42 is formed near the crossing of the gate signal line 51 and drain signal line 61. Both drains of the TFTs 41 and 42 are connected to the drain signal line 61 and both gates of these TFTs are connected to a circuit selection signal line 88. Either one of TFTs 41 or 42 turns on based on a selection signal from the circuit selection signal line 88. Also, as explained later, a circuit selection circuit 43 is formed, paring with the circuit selection circuit 40.

Therefore, selecting as well as changing between the analog display mode (full color moving image) and the digital display mode (low power consumption, still image) becomes possible. Also, a pixel element selection circuit 70 having an N channel TFT 71 and an N channel TFT 72 is formed adjacent to the circuit selection circuit 40. The pixel element selection TFTs 71 and 72 are connected to the circuit selection TFTs 41 and 42 of the circuit selection circuit 40 in a vertical direction, respectively. Also, both gates of the TFTs 71, 72 are connected to the gate signal lines 51. Both of the TFTs 71 and 72 turn on simultaneously in response to the scanning signal fed from the gate signal line 51.

A storage capacitance element 85 holds the analog image signal in the analog mode. One electrode 86 of the storage capacitance element 85 is connected to the source 71*s* of the TFT 71. Another electrode 87 is connected to a common storage capacitance line SCL and is provided with a bias voltage VCS. When the analog image signal is applied to the liquid crystal 21 after opening of the TFT gates of the circuit selection circuit 70, the voltage of the applied signal reduces even during a one-field period, resulting in loosing the homogeneity of the display image. The storage capacitance element 85 maintains the applied voltage at the initial level during one field period for eliminating the problem above.

A P channel TFT 44 of the circuit selection circuit 43 is placed between the storage capacitance element 85 and the liquid crystal 21, and turns on and off in synchronization with the switching of the TFT 41 of the circuit selection circuit 43. A static memory circuit 110 and a signal selection circuit 120 are placed between the TFT 72 of the pixel element selection circuit 70 and the display electrode 80 of the liquid crystal 21.

The static memory circuit 110 has two inverter circuits, the first and second inverter circuits, which are positively fed back to each other. The source 72*s* of the pixel element selection TFT 72 is connected to an input terminal of the first inverter circuit INV1, and its output is inputted to the second inverter circuit INV2. Also, an output terminal of the second inverter circuit INV2 is connected to the input terminal of the first inverter circuit INV1.

Under the digital display mode, when the voltage of the circuit selection signal line 88 as well as the scanning signal of the gate signal line 51 becomes "H", the static memory circuit 110 is ready to for the writing.

The signal selection circuit 120 is the circuit selecting the signal based on the digital image signal retained in the static memory circuit 110 and comprises two N-channel TFTs 121, and 122. The output signal is complimentarily supplied from the static memory circuit 110 to the gates of the TFTs 121, 122, and the TFTs 121, 122 complimentarily turn on and off.

Here, the common electrode signal VCOM (signal B) is selected when the TFT 122 turns on, and the AC drive signal (signal A) is selected when the TFT 121 turns on. The selected signal is then applied to the display electrode 80, which supplied the voltage to the liquid crystal 21, through the TFT 45 of the circuit selection circuit 43.

The liquid crystal panel 100 has a peripheral circuit as well. An LSI 91 for driver scanning is mounted on an external circuit board 90 externally attached to the insulating substrate 10 of the liquid crystal panel 100. The LSI 91 sends the vertical start signal STV and the horizontal start signal STH to the gate driver 50 and the drain driver 60, respectively.

The panel driver LSI also feeds the image signal to the data line 62.

Figure 5:
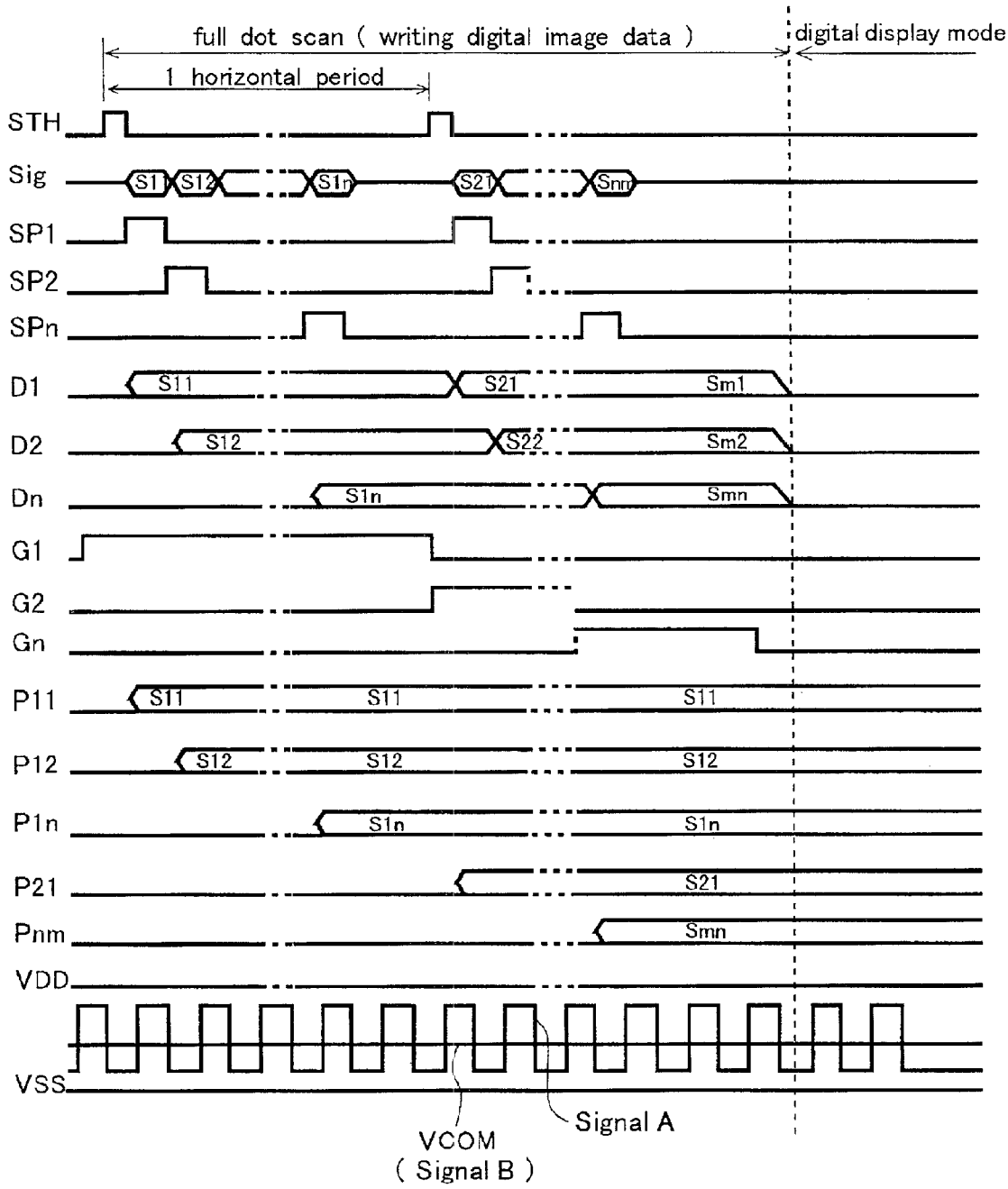
FIG. 5 is a timing chart of the display device under a digital display mode.
Figure 6:
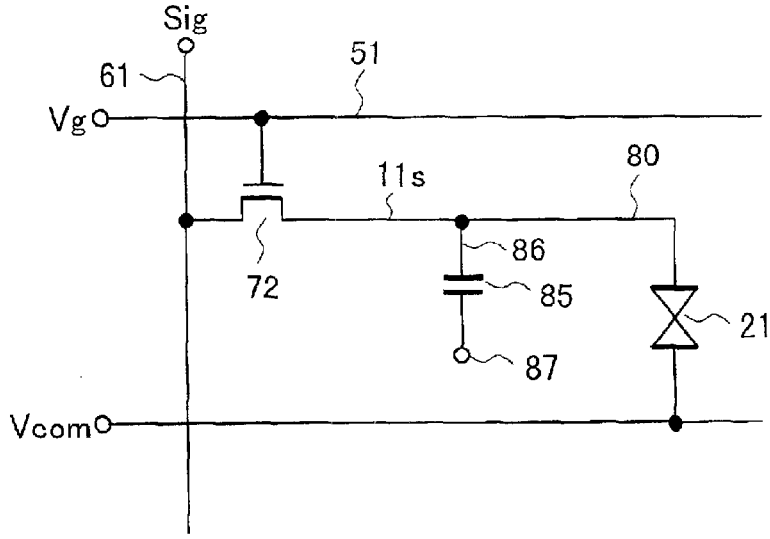
Fig.6 PRIOR ART
FIG. 6 is a circuit diagram of a conventional liquid crystal display device.
Figure 7:
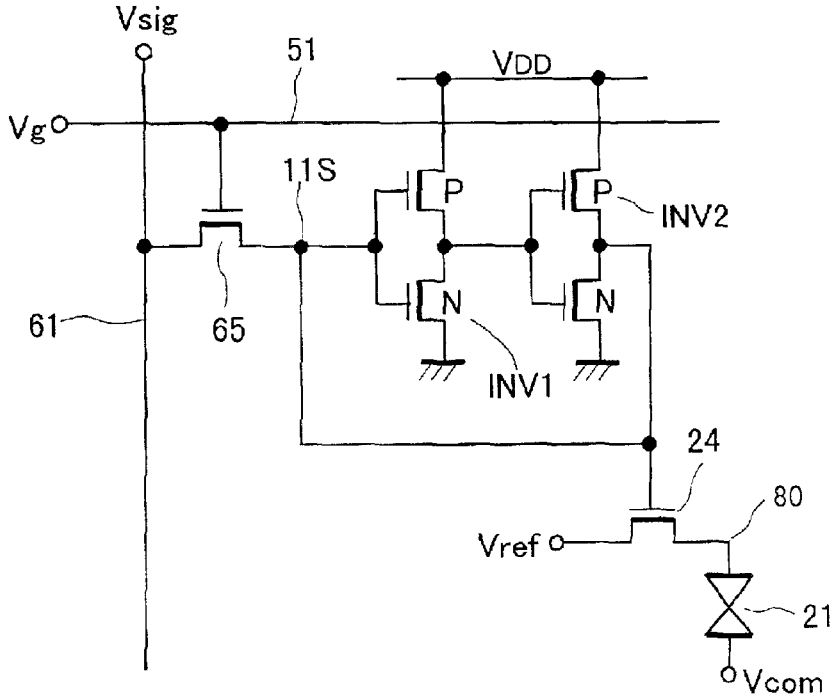
Fig.7 PRIOR ART
FIG. 7 is a circuit diagram of another conventional liquid crystal display device.

The driving method of the display device described above will be explained hereinafter in reference to FIGS. 4 and 5. FIG. 5 shows a timing chart for when the liquid crystal display device is set to operate under the digital display mode.

(1) Analogue Display Mode.

When the analog display mode is selected in response to the mode selection signal MD, the analog image signal is outputted to the data signal line 62 through the DA converter 3 and the amplifier 4. Also, the voltage applied to the circuit selection signal line 88 changes to "L" so that the TFTs 41, 44 of the circuit selection circuits 40, 43 turn on.

The sampling transistor SP turns on in response to the sampling signal based on the horizontal start signal STH so that the analog image signal is supplied to the drain signal line 61 through the data signal line 62.

Also, the scanning signal is supplied to the gate signal line 51 in accordance with the vertical start signal STV. When the TFT 71 turns on in response to the scanning signal, the analog image signal Sig is applied through the drain signal line 61 to the display electrode 80 and the storage capacitance element 85, which holds the applied voltage. The liquid crystal 21 aligns itself in accordance with the image signal voltage applied to the liquid crystal 21 fed from the display electrode 80, resulting in a display image.

The analog display mode is suitable for showing a full color moving picture.

(2) Digital Display Mode

When the digital display mode is selected in response to the mode selection signal MD, the data signal line 62 is set to receive the digital image signal. At the same time, the voltage of the circuit selection signal line 88 turns to "H", and the static memory circuit 110 is set to be operable.

Here, as described before, the digital image signal is inputted to the data signal line 62 through the DA converter 3 and the amplifier 4 after being processed by the signal processing circuit 1.

Also, the TFTs 42 and 45 turn on when the TFTs 41, 44 of the circuit selection circuits 40, 43 turn off. The LSI 91 for driver scanning on the external circuit board 90 sends start signals STV, STH to the gate driver 50 and the drain driver 60, respectively. In response to the start signals, the sampling signals are sequentially generated and turn on the respective sampling transistors SP1, SP2, - - - SPn sequentially, which sample the digital image signal Sig and send it to each of the drain signal lines 61.

The operation of the first row of the matrix, or the operation of the gate signal line 51, which receives the scanning signal G1, will be described below. First, the scanning signal G1 turns on each TFT of the pixel elements, P11, P12, - - - P1n, connected to the gate signal line 51, for one horizontal field period.

In the pixel element P11 located at the upper left corner of the matrix, the sampling signal SP1 takes in the digital image signal S11 and feeds it to the drain signal line 61. The scanning signal G1 becomes "H", turning the TFT 70 on. Thus, the drain signal D1 is written into the static memory circuit 110.

Under the digital display mode, the level of the digital image signal S11 is the divalent output having the high voltage (VH) and the low voltage (VL). Therefore, writing into the static memory circuit 110 is possible by setting the threshold voltage of the static memory circuit 110 between the high voltage (VH) and the low voltage (VL).

The signal retained by the static memory circuit 110 is then fed to the signal selection circuit 120, and the signal selection circuit 120 selects either signal A or signal B. The selected signal is then applied to the liquid crystal 21 through the display electrode 80. Thus, when the scanning is done from the first gate signal line 51 on the top row of the matrix to the last gate signal line 51 on the bottom row of the matrix, a full display frame scan (one field scan) is completed.

Then, the display in accordance with the signals held in the static memory circuit 110 (still picture display) appears. Under this digital display mode, the supply of the power voltage to the circuits, such as the gate driver 50, the drain driver 60 and the external LSI 91, is halted. In the meantime, the static memory circuit 110 continuously receives the voltages VDD, VSS. Also, the common electrode 32 receives the common electrode voltage and the signal selection circuit 120 receives the signal A and the signal B.

That is, when the static memory circuit 110 receives the VDD, VSS for its operation and when the common electrode voltage VCOM is applied to the common electrode, the liquid crystal display panel 100 is in the normally-white (NW) mode. In this mode, the same voltage as the common electrode 32 is applied to the signal B and the AC drive voltage (for example 60 HZ) for driving the liquid crystal is applied to the signal A.

In this way, the data for one still picture is retained and displayed. Other circuits such as the gate driver 50, the drain driver 60 and the external LSI 91 do not receive any voltage.

When the static memory circuit 110 receives the "H (high)" digital image signal through the drain signal line 61, at the signal selection circuit 120, the first TFT 121 receives an "L" signal and, accordingly, turns off, and the second TFT 122 receives an "H" signal and, accordingly, turns on.

In this case, the signal B is selected and the liquid crystal 21 receives the signal B having the same voltage as VCOM applied to the common electrode 32. As a result, there is no change in the arrangement of the liquid crystal 21 and the display element stays white.

When the static memory circuit 110 receives the digital image signal of "L" through the drain signal line 61, at the signal selection circuit 120, the first TFT 121 receives an "H" signal and, accordingly, turns on, and the second TFT 122 receives an "L" signal and, accordingly, turns off. In this case, the signal A is selected and the liquid crystal 21 receives the signal A, which is the AC drive signal, resulting in the rearrangement of the liquid crystal 21. Since the display panel is in an NW mode, a black image results.

In the above embodiment, a one-bit digital data signal is used in the digital display mode. However, this invention is not limited to that embodiment, and is also applicable to a multiple-bit digital data signal. In such a configuration, a multi-gray scale image representation is possible. Also, it is necessary to provide the retaining circuits and the signal selection circuits in accordance with the number of the bits used in the system. Also, alternation of the signal processing circuit 1 is required in such application.

In the display device of this invention, the analog signal amplifier can be imitatively used as the digital driver. That is, the voltage amplitude of the digital image signal can be amplified by using the analog signal amplifier, leading to simplification of the circuit design.

The above is a detailed description of a particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. A display device comprising:

a signal processing circuit processing a digital image signal comprising at least two bits;

a digital-analog converter converting the processed digital image signal into an analog image signal;

an analog image signal amplifier amplifying the analog image signal outputted from the digital-analog converter;

a static memory circuit retaining an amplified image signal amplified by the analog signal amplifier; and a display circuit displaying an image based on the image signal retained in the static memory circuit, wherein the signal processing circuit processes the digital image signal so that the processed digital image signal is converted to one of only two values by the digital-analog converter, the two values being a high level and a low level.

2. A display device comprising:

a signal processing circuit processing a digital image signal comprising at least two bits;

a digital-analog converter converting the processed digital image signal into an analog image signal;

an analog signal amplifier amplifying the analog image signal outputted from the digital-analog converter;

a first display circuit receiving the analog image signal amplified by the analog signal amplifier and operating in an analog display mode based on the analog image signal; and a second display circuit having a static memory circuit retaining the image signal fed through the digital-analog converter and the analog signal amplifier, the second display circuit operating in a digital display mode based on the image signal retained in the static memory circuit, wherein the first display circuit or the second display circuit is selected corresponding to the analog display mode or the digital display mode, respectively, and, when the second display circuit is selected, the signal processing circuit processes the digital image signal so that the processed digital image signal is converted to one of only two values by the digital-analog converter, the two values being a high level and a low level.

3. The display device of claim 1 or 2, wherein the signal processing circuit converts all bits of the digital image signal into a 1 when a top bit of the signal is a 1 and converts all bits of the digital image signal into a 0 when the top bit is a 0.

4. The display device of claim 1 or 2, wherein a threshold voltage of the static memory circuit is set between the high level and the low level.

5. The display device of claim 1 or 2, wherein the static memory circuit comprises a first inverter circuit and a second inverter circuit positively feeding back to each other.

6. A display device comprising:

a signal processing circuit processing a digital image signal comprising at least two bits;

a digital-analog converter converting the processed digital image signal into an analog image signal;

an analog signal amplifier amplifying the analog image signal outputted from the digital-analog converter;

a first display circuit receiving the analog image signal amplified by the analog signal amplifier and operating in an analog display mode based on the analog image signal; and a second display circuit having a static memory circuit retaining the image signal fed through the digital-analog converter and the analog signal amplifier, the second display circuit operating in a digital display mode based on the image signal retained in the static memory circuit, wherein when the first display circuit is selected in the analog display mode, the signal processing circuit processes the digital image signal so that the processed digital image signal is converted to one of more than two levels by the digital-analog converter, and when the second display circuit is selected in the digital display mode, the signal processing circuit processes the digital image signal so that the processed digital image signal is converted to one of only two levels by the digital-analog converter.

* * * * *